United States Patent [19]

Feucht et al.

[11] 4,034,942

[45] July 12, 1977

[54] METHOD OF LEADING A RAIL VEHICLE BY MEANS OF A CONTROL CENTER FROM AN AUTOMATICALLY CONTROLLED AREA TO AN AREA OF INDIVIDUAL CONTROL

[75] Inventors: Ulrich Feucht, Ditzingen; Martin Michler, Stuttgart-Ost, both of Germany

[73] Assignee: International Standard Electric Corporation, New York, N.Y.

[21] Appl. No.: 665,489

[22] Filed: Mar. 10, 1976

[30] Foreign Application Priority Data

Mar. 24, 1975 Germany ..... 2512910

[51] Int. Cl.[2] ..... B61C 3/02

[52] U.S. Cl. ..... 246/4; 246/167 R; 246/182 B; 246/187 B

[58] Field of Search ..... 104/149, 152; 235/150.2, 150.24; 246/4, 5, 63 R, 63 C, 167 R, 182 R, 182 B, 182 C, 187 R, 187 A, 187 B

[56] References Cited

U.S. PATENT DOCUMENTS

| | | | |
|---|---|---|---|
| 3,676,669 | 7/1972 | Jauquet | 246/63 C X |
| 3,748,466 | 7/1973 | Sibley et al. | 246/63 C |
| 3,937,432 | 2/1976 | Birkin | 246/167 R X |

*Primary Examiner*—Stephen G. Kunin

*Attorney, Agent, or Firm*—John T. O'Halloran; Alfred C. Hill

[57] ABSTRACT

The present invention relates to an automated railway system and to a method of leading a vehicle by means of a control center from an automatically controlled area to an area of individual control. The speed-determining criteria in the area of individual control, for example, maximum speeds and stopping points, are stored in the control center and used to determine a transition speed and a transfer point which, in turn, are communicated as corresponding running commands to the vehicle still being in the area of the control center.

6 Claims, 6 Drawing Figures

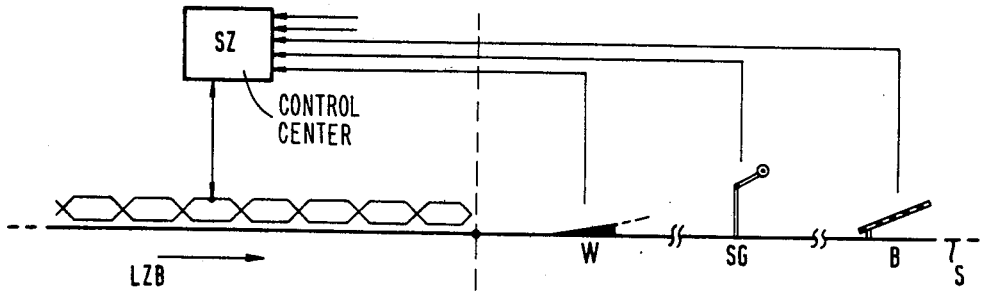
Fig.1
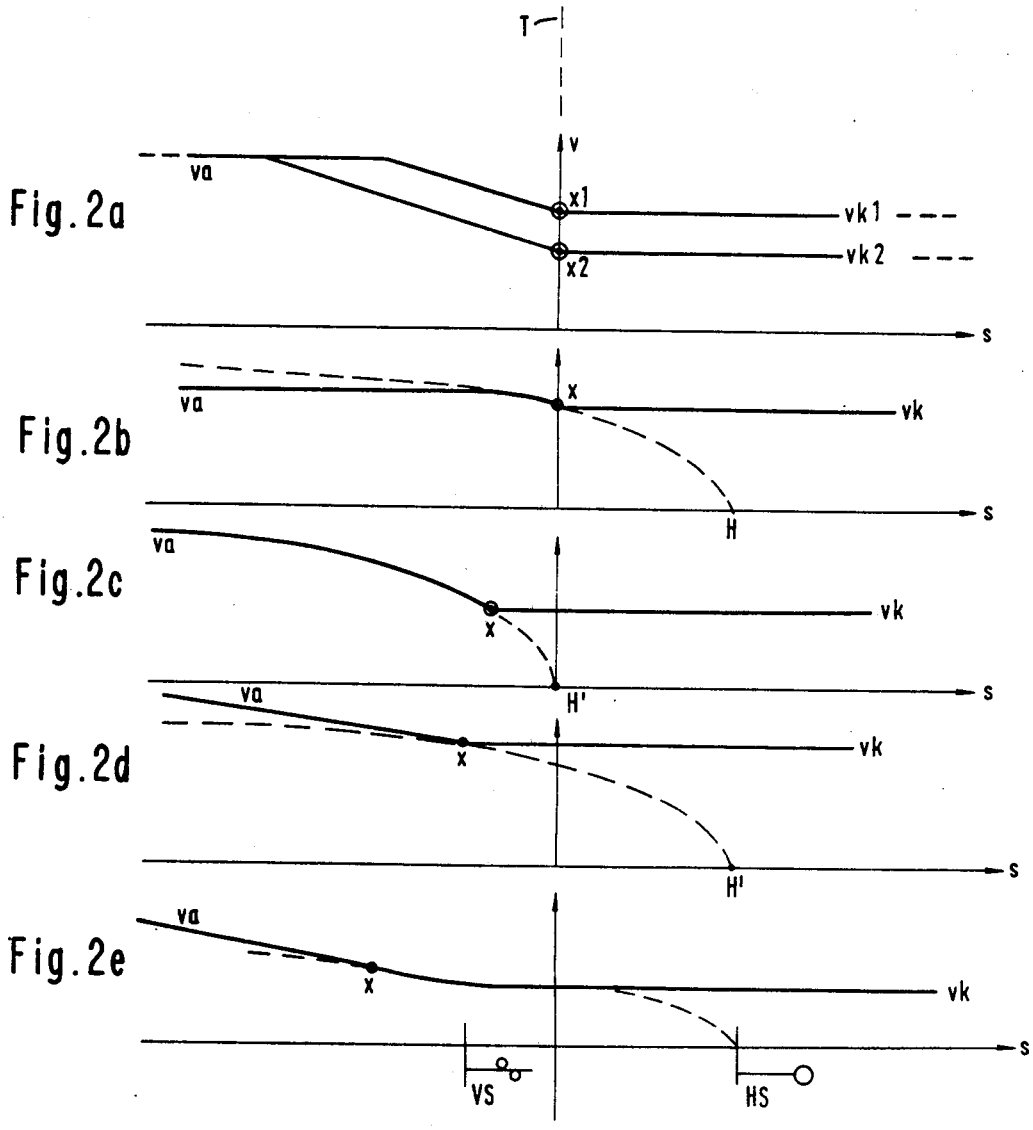

METHOD OF LEADING A RAIL VEHICLE BY MEANS OF A CONTROL CENTER FROM AN AUTOMATICALLY CONTROLLED AREA TO AN AREA OF INDIVIDUAL CONTROL

BACKGROUND OF THE INVENTION

The present invention relates to a method of leading a vehicle by means of a control center from an automatically controlled area to an area of individual control, taking into account signals and the like.

Automation in railway systems is on the increase. The German Federal Railway uses a continuous automatic train control system (German abbreviation: LZB) in which the vehicles are connected through induction loops to an associated control center from which they receive running commands.

On the other hand, there are, and will be in the foreseeable future, lines which are not equipped with the LZB system; there, train operation is controlled by conventional means, e.g. signals.

Accordingly, LZB-equipped lines and conventional lines will coexist for some time to come. This poses the problem of adapting LZB-equipped lines to conventional lines, and vice versa, with safety considerations being of particular importance.

SUMMARY OF THE INVENTION

It the object of the invention to solve this problem if a vehicle passes from the automatically controlled area (LZB) to an area of individual control.

THe invention is characterized in that speed-determining criteria in the area of individual control, e.g. maximum speeds and stopping points, are stored in the control center and used to determine a transition speed and a transfer point, which, in turn, are communicated as corresponding running commands to the vehicle still being in the area of the control center.

BRIEF DESCRIPTION OF THE DRAWINGS

The invention will now be explained in more detail with reference to the accompanying drawing, in which:

FIG. 1 illustrates the problem the invention is to solve and the principle of solution, and FIGS. 2*a* to 2*e* show embodiments of the practical realization of the inventive idea.

DESCRIPTION OF THE PREFERRED EMBODIMENT

FIG. 1 shows a track S on which a train is travelling in the direction of the arrow. The left portion of the track, designated LZB, is under the automatic control of a control center SZ which exchanges data with the vehicle via induction loops, indicated by hexagons. The control center SZ and the equipment in the vehicle communicating with the control center may be implemented as disclosed in British Pat. No. 1,117,123, whose disclosure is incorporated herein by reference, or the article by Dr.-ING. W. Koth entitled "DB Track-To-Train Communication", Railway Gazette, May 1, 1970, pages 334–337 and 340, whose disclosure is incorporated herein by reference. The right portion of the track S is a portion of conventional control where the vehicle is controlled individually taking into account the route conditions. Speed determining factors are, for example, a switch W, a signal SG, a level crossing B, etc.

Such a portion of track may also be a normally LZB controlled portion whose data exchange with its associated control center has been interrupted due to a defect.

The principle of the invention consists in the fact that the line data of the area of individual control contiguous to the automatically controlled area is at the disposal of the control center SZ of the automatically controlled area. This information may be "maximum speed 100 km/h", "next signal at stop", etc.

The control center SZ calculates or takes from this information a transition speed *vk* and controls the leaving vehicle accordingly. This ensures a continuous transition, and the vehicle leaves the automatically controlled area at a transition speed *vk* which is adapted to the route condition in the area of individual control. It is also possible to turn over the vehicle to the individual control already in the automatically controlled area when the transition speed *vk* has been reached.

FIGS. 2*a* to 2*e* show various possibilities of determining the transition speed *vk* and a transfer point X.

In FIG. 2*a*, the vehicle is travelling in the LZB area at a speed *va* which lies above the speed Vmax1 or Vmax2 permissible in the area of individual control. Accordingly, the vehicle will be slowed down to the transition speed $vk1=V\max 1$ or $vk2=V\max 2$ and leave the LZB area at the transfer point X1 or X2, which coincides with the common boundary T of the two areas.

In the example of FIG. 2*b*, the control center SZ reduces the speed *va* to such a point that at the transition at the common boundary T a speed *vk* has been reached which allows the vehicle to be stopped until it arrives at the next possible stopping point H.

FIG. 2*c* shows another possibility. The common boundary T is assumed to be a fictitious stopping point H', and the vehicle is slowed down as if it were to stop at the common boundary T. When the permissible speed *vk* has been reached, the control center SZ will release the vehicle. In this instance, the transfer point X lies in the LZB area. FIG. 2*d* differs from the method of FIG. 2*c* in that the assumed stopping point H' lies in the area of individual control and corresponds to the next possible stopping point.

In FIG. 2*e*, the transfer point X has been placed in front of the last distance signal VS within the LZB area so that the driver can take note of the position of the distance signal under the conditions of individual control (caution) and thus approaches the next main signal HS at the permissible speed and without any loss of information. The transition speed *vk* again corresponds to the maximum permissible speed Vmax in the area of individual control.

In the last three examples, the control center releases the vehicle already within the LZB area. This requires additional commands (e.g. "render automatic brake inactive") to be sent to the vehicle because otherwise the vehicle assumes that there is a defect and stops automatically.

Although the principles of the present invention are described above in relation with specific examples, it should be understood that the description is given as an example only and does not limit the scope of the invention.

What is claimed is:

1. A method of leading a vehicle by means of a control center from an automatically controlled area to an area of individual control, taking into account signals and the like, comprising the steps of storing in said control center speed determining criteria in the area of individual control, e.g. maximum speed and stopping points;

determining from said stored criteria a transition speed between said two areas and a transfer point between said two areas; and communicating said transition speed and said transfer point as running commands to said vehicle when it is still in said automatically controlled area.

2. A method according to claim 1, further including the steps of reducing the speed of said vehicle in said automatically controlled area to the maximum speed permissible in said area of individual control, and said transfer point is the common boundary of said two areas.

3. A method according to claim 1, wherein said transfer point is the common boundary of said two areas, and said transition speed is selected so that said vehicle can be stopped by individual control at the first possible stopping point in said area of individual control.

4. A method according to claim 1, further including the step of reducing the speed of said vehicle in said automatically controlled area as if said vehicle were to stop at the common boundary of said two areas; and turning said vehicle over to individual control by said control center before said common boundary when said vehicle has reached the maximum permissible speed in said automatically controlled area.

5. A method according to claim 1, further including the steps of reducing the speed of said vehicle in said automatically controlled area until said vehicle could be stopped by individual control at the first possible stopping point in said area of individual control; and turning said vehicle over to individual control by said control center.

6. A method according to claim 1, further including the step of turning said vehicle over to individual control by said control center before a last distance signal within said automatically controlled area.

* * * * *